US009387144B2

(12) United States Patent
Brignone et al.

(10) Patent No.: US 9,387,144 B2
(45) Date of Patent: Jul. 12, 2016

(54) ADJUSTABLE CRUTCH

(71) Applicants: Renato Brignone, Verbania (IT); Paolo Villa, Meda (IT)

(72) Inventors: Renato Brignone, Verbania (IT); Paolo Villa, Meda (IT)

( * ) Notice: Subject to any disclaimer, the term of this patent is extended or adjusted under 35 U.S.C. 154(b) by 0 days.

(21) Appl. No.: 14/399,961

(22) PCT Filed: May 10, 2013

(86) PCT No.: PCT/IB2013/053814
§ 371 (c)(1),
(2) Date: Nov. 9, 2014

(87) PCT Pub. No.: WO2013/168144
PCT Pub. Date: Nov. 14, 2013

(65) Prior Publication Data

US 2015/0144167 A1 May 28, 2015

(30) Foreign Application Priority Data

May 11, 2012 (IT) ..... MI2012A0816

(51) Int. Cl.
*A61H 3/02* (2006.01)
*A63C 11/22* (2006.01)

(52) U.S. Cl.
CPC ..... *A61H 3/02* (2013.01); *A61H 3/0288* (2013.01); *A63C 11/22* (2013.01); *A61H 2201/0192* (2013.01); *A63C 2201/10* (2013.01)

(58) Field of Classification Search
CPC ... A61H 3/02; A61H 3/00; A61H 2201/1635; A61H 2003/006; A61H 2003/0211; A61H 2003/0233; A61H 2003/0222; A61H 2003/2382; A61H 3/0288; A63C 11/22
USPC ..... 135/65–66, 68, 69, 71–73, 81, 84; 16/430; 280/819
See application file for complete search history.

(56) References Cited

U.S. PATENT DOCUMENTS

| | | | | | |
|---|---|---|---|---|---|
| 2,388,778 | A | * | 11/1945 | Wheeler | 135/68 |
| 2,409,365 | A | * | 10/1946 | Lamb | 135/71 |
| 3,901,258 | A | * | 8/1975 | Montgomery | 135/68 |
| 3,948,535 | A | * | 4/1976 | Negi | 280/816 |
| 4,151,853 | A | * | 5/1979 | Inbar | 135/71 |
| 4,787,405 | A | * | 11/1988 | Karwoski | 135/66 |
| 5,193,567 | A | * | 3/1993 | Razny, Jr. | 135/68 |
| 5,711,334 | A | * | 1/1998 | Roux | 135/65 |
| 2009/0114257 | A1 | * | 5/2009 | Sutton | 135/72 |
| 2010/0236590 | A1 | * | 9/2010 | Diaz | 135/71 |

FOREIGN PATENT DOCUMENTS

| | | | |
|---|---|---|---|
| JP | 2007014613 | A | * 1/2007 |
| JP | 2008086610 | A | * 4/2008 |
| JP | 2009268655 | A | * 11/2009 |

* cited by examiner

*Primary Examiner* — Winnie Yip
(74) *Attorney, Agent, or Firm* — The Bilicki Law Firm, P.C.

(57) ABSTRACT

A crutch includes: a handgrip (2) extending along a first axis (AA1); a forearm support (3), provided with a stem (3*b*) which extends along a second axis (AA2) and is connected to a rear end (2*a*) of the handgrip (2); a support pole (4), extending along a third axis (AA3) and connected to a front end (2*a*) of the handgrip (2); and adjusting members (5), configured to adjust an angular position of at least one of the support pole (4) and the forearm support (3) with respect to the handgrip (2).

14 Claims, 7 Drawing Sheets

ADJUSTABLE CRUTCH

TECHNICAL FIELD

The present invention concerns an adjustable crutch.

BACKGROUND ART

As is known, forearm crutches are one of the commonest walking aids. A forearm crutch essentially comprises a support pole, a forearm support and a handgrip. The support pole and the forearm support extend along, respective axes, are consecutive and form an obtuse angle between each other. The handgrip extends from the joining point between the pole and the forearm support, in a substantially perpendicular direction to the support pole.

Although the support poles are generally height-adjustable and the forearm supports are available in different sizes, the margins for adapting the configuration of the crutches to the characteristics and to the specific modes of use of the user are very limited.

Consequently, also the stability of the ground contact and the distribution of the load during walking are not optimal. Apart from the risk of falls, the non-optimal load can cause excessive user fatigue and, with prolonged use, inflammatory conditions and other pathologies which also tend to become chronic.

DISCLOSURE OF INVENTION

The object of the present invention is to provide a crutch which overcomes the limitations described and, in particular, can be flexibly adapted to the characteristics of the user.

According to the present invention, a crutch is produced as defined in claim 1.

BRIEF DESCRIPTION OF THE DRAWINGS

For a better understanding of the invention, some embodiments thereof will now be described, purely by way of non-limiting example and with reference to the accompanying drawings, in which.

BEST MODE FOR CARRYING OUT THE INVENTION

Figure 2:
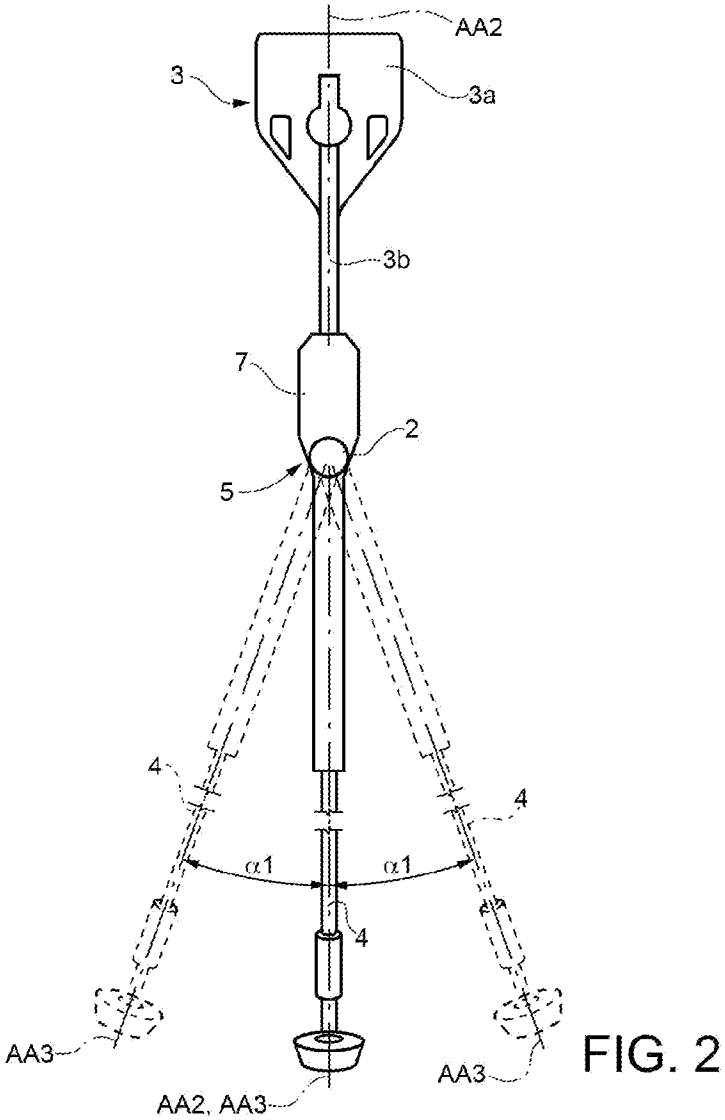
FIG. 2 is a front view of the crutch of FIG. 1.
Figure 1:
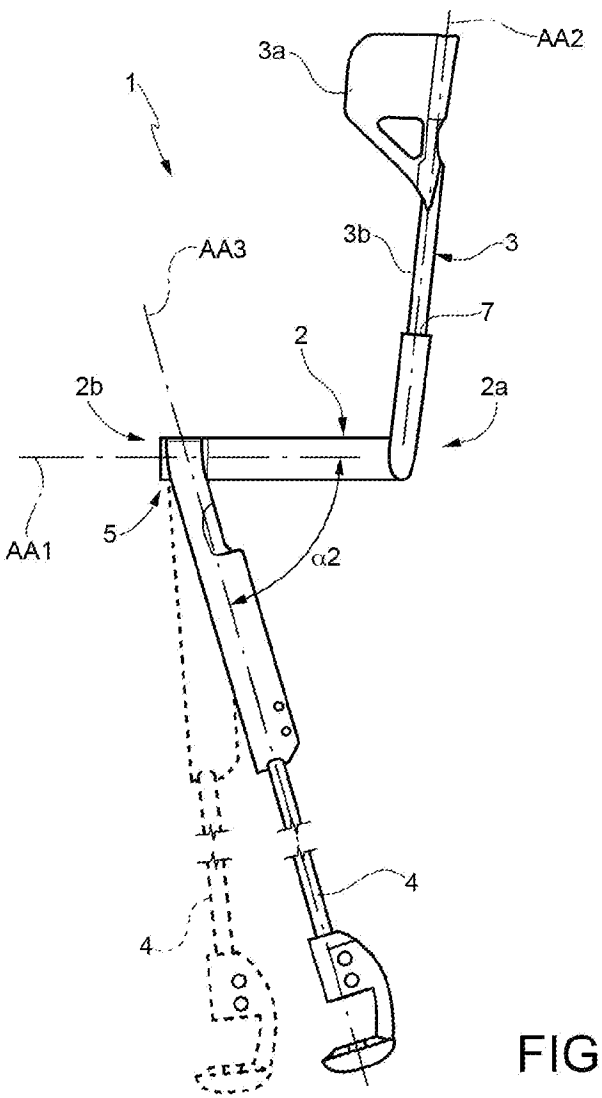
FIG. 1 is a right-hand lateral view of a crutch according to an embodiment of the present invention.

With reference to FIGS. 1 and 2, a crutch according to an embodiment of the present invention is indicated as a whole by number 1.

The crutch 1 comprises a handgrip 2, a forearm support 3, a support pole 4 and adjusting members 5, for adjusting an angular position of the support pole 4 with respect to the handgrip 2 and the forearm support 3.

The handgrip 2 extends along a first axis AA1 and has a flattened shape in the upper portion, to facilitate gripping by a user.

The forearm support 3 extends along a second axis AA2 and comprises a support element 3*a* fitted to a stem 3*b*, which is connected to a rear end 2*a* of the handgrip 2. In particular, in the embodiment described here, the stem 3*b* of the forearm support 3 is inserted in a coupling 7 and tightened therein for example by a screw, not shown. The screw tightening can be released to height-adjust the forearm support 3.

The support pole 4 is defined by a tubular body which extends along a third axis AA3 and is connected to a front end 2*b* of the handgrip 2 via the adjusting members 5. The support pole 4 may be made, for example, but not exclusively, of titanium, aluminium, steel or carbon fibre. In one embodiment, the support pole 4 is provided, at a lower end, with a supporting foot 6 connected by means of a shock absorber element 6*a*.

As shown in FIGS. 1 and 2, the adjusting members 5 allow modification of the direction of the third axis AA3 so as to adjust a first angle $\alpha 1$ between the axis AA3 and a plane defined by the first axis AA1 and the second axis AA2 (FIG. 2) and a second angle $\alpha 2$ between the third axis AA3 and the first axis AA1 (i.e. between the support pole 4 and the handgrip 2, FIG. 1).

Figure 3:
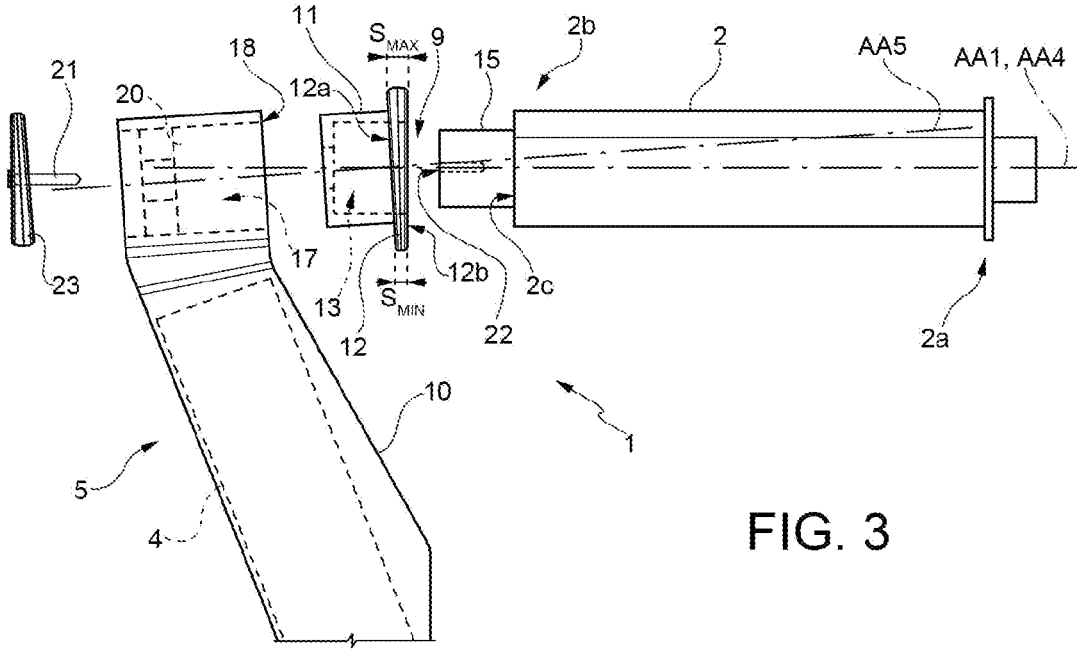
FIG. 3 is an exploded right-hand lateral view of an enlarged detail of the crutch of FIG. 1 in a first operating configuration.
Figure 4:
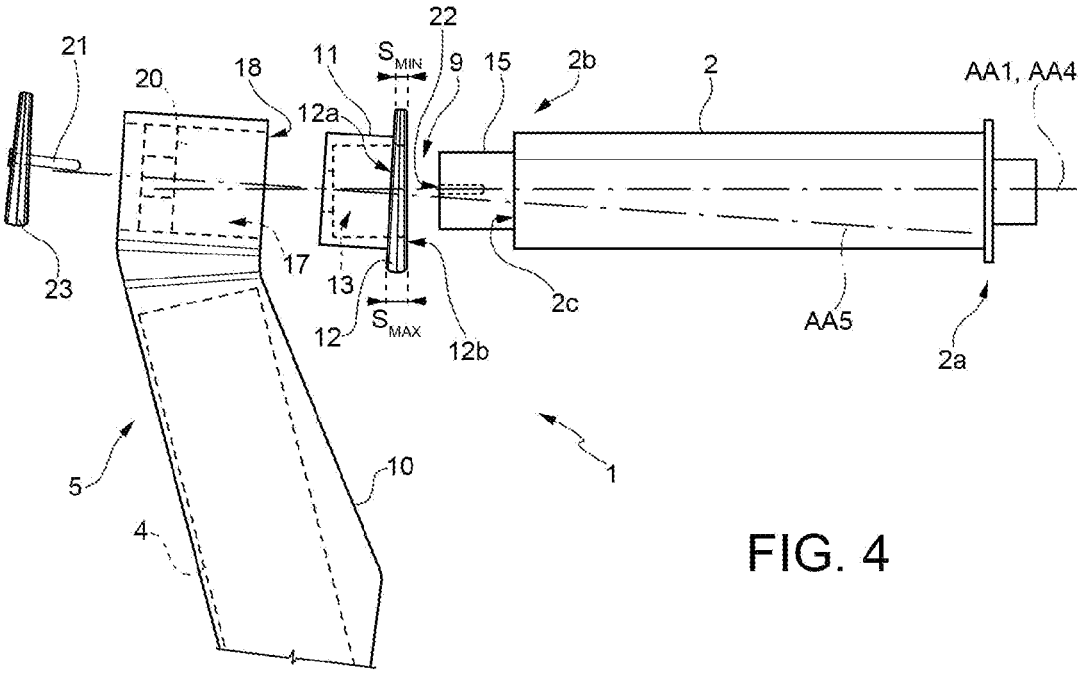
FIG. 4 is an exploded right-hand lateral view of the detail of FIG. 3, in a second operating configuration.

In one embodiment, the adjusting members 5 comprise a first articulated joint element 9 and a second articulated joint element 10, as shown in further detail in the exploded views of FIGS. 3 and 4.

The first articulated joint element 9 comprises a body having a cylindrical portion 11 and a flange 12 adjacent to the cylindrical portion 11.

In the embodiment described, the cylindrical portion 11 of the first articulated joint element 9 has a cavity 13 open on the side of the flange 12 and blind on the opposite side. A longitudinal axis AA4 of the cavity is offset with respect to a longitudinal axis AA5 of the cylindrical portion 11 and, in the example described, coincides with the first axis AA1 of the handgrip 2.

The flange 12 has a first face 12*a*, adjacent to the cylindrical portion 11 and perpendicular to the longitudinal axis AA5 of the cylindrical portion 11, and a second face 12*b*, sloping with respect to the first face 12*a* and perpendicular to the longitudinal axis AA4 of the cavity 13. A thickness of the flange 12 is therefore variable between a minimum thickness point SMIN and a maximum thickness point SMAX, diametrically opposite each other.

The first articulated joint element 9 is press-fitted on a pin 15 at the front end 2*b* of the handgrip 2, which fits into the cavity 13. The second face 12*b* of the flange 12 abuts against a backing surface 2*c* of the handgrip 2 and is perpendicular to the first axis AA1 of the handgrip 2. In one embodiment, the first axis AA1 of the handgrip 2 is parallel to and preferably aligned with the longitudinal axis AA4 of the cavity 13. The longitudinal axis AA5 of the cylindrical portion 11 of the first articulated joint element 9 forms, with the first axis AA1, an angle that depends on the position of the first articulated joint element 9 with respect to the handgrip 2. In further detail, the first articulated joint element 9 may be selectively coupled with the handgrip 2 in one of a first position and a second position. In the first position (FIG. 3), the maximum thickness point SMAX and the minimum thickness point SMIN of the flange 12 are arranged respectively below and above the longitudinal axis AA5 of the cylindrical portion 11 of the flange 12. In the second position (FIG. 4), on the other hand, the maximum thickness point SMAX and the minimum thickness point SMIN of the flange 12 are arranged respectively above and below the longitudinal axis AA5 of the cylindrical portion 11 of the flange 12.

The second articulated joint element 10 is fitted on an upper end of the support pole 4 and has a cylindrical seat 17 rotatably coupled to the cylindrical portion 11 of the first articulated joint element 9, which acts as a pin. The longitudinal axis AA5 of the cylindrical portion 11 of the first articulated joint element 9 therefore defines a pin axis for the second articulated joint element 10 and, in the embodiment described, lies on a plane defined by the first axis AA1 of the handgrip 2 and by the second axis AA2 of the forearm support 3.

Around the cylindrical seat 17, the second articulated joint element 10 has a sliding surface 18 perpendicular to an axis of the cylindrical seat 17. When the first articulated joint element 9 and the second articulated joint element 11 are coupled, the sliding surface 18 is arranged against the first face 12*a* of the flange 12 and allows rotation of the second articulated joint element 10 around the cylindrical portion 11 of the first articulated joint element 9. Furthermore, the third axis AA3 of the support pole 4 is transverse to the longitudinal axis AA5 of the cylindrical portion 11 of the first articulated joint element 9. The orientation of the sliding surface 18 and of the third axis AA3 is therefore determined by the position of the flange 12 and may be adjusted by arranging the first articulated joint element 9 in the first position or in the second position.

The cylindrical seat 17 is delimited, on the side opposite the first articulated joint element 9, by a wall 20. A screw 21 is coupled to a seat 22 in the pin 15 through the wall 20 and pack-tightens in a reversible manner the first articulated joint element 9 and the second articulated joint element 10, preventing the relative rotation. The tightening is obtained thanks also to a plate 23, the faces of which are tilted so as to compensate for the tilting of the faces 12*a*, 12*b* of the flange 12. The adjusting members 5 therefore allow locking of the handgrip 2, the forearm support 3 and the support pole 4 selectively in one of a plurality of relative positions in which the third axis AA3 is transverse to the plane defined by the first axis AA1 and by the second axis AA2. In this way, it is possible to adjust the supporting base according to the needs and comfort of the user, maintaining the aperture of the arms unchanged with respect to the trunk.

Figure 5:
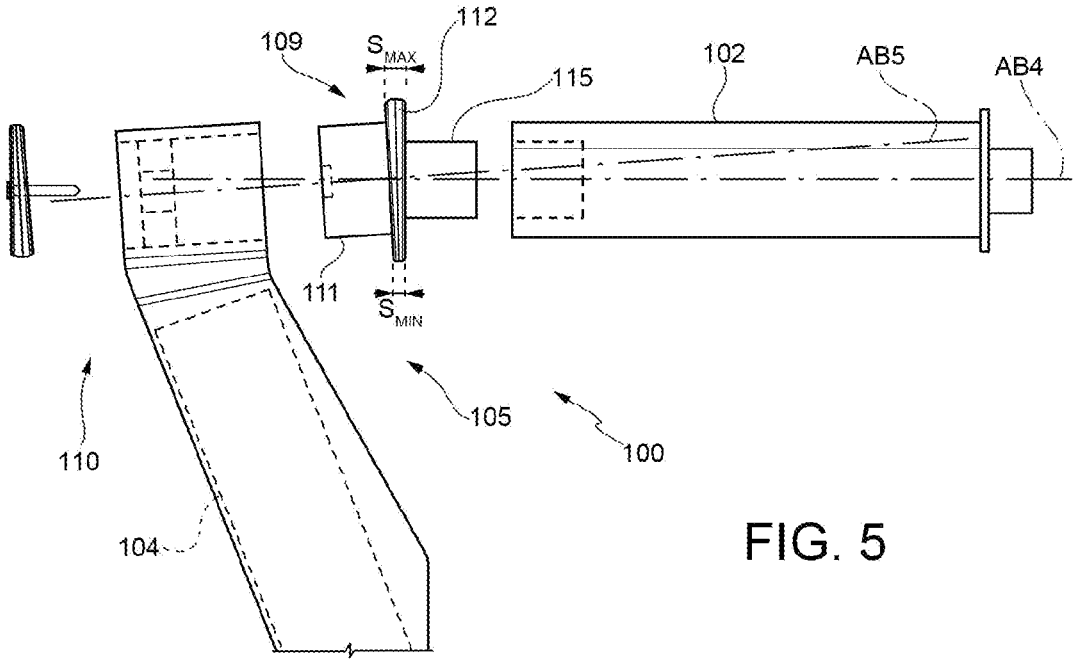
FIG. 5 is an exploded right-hand lateral view of an enlarged detail of a crutch according to a different embodiment of the present invention, in a first operating configuration.
Figure 6:
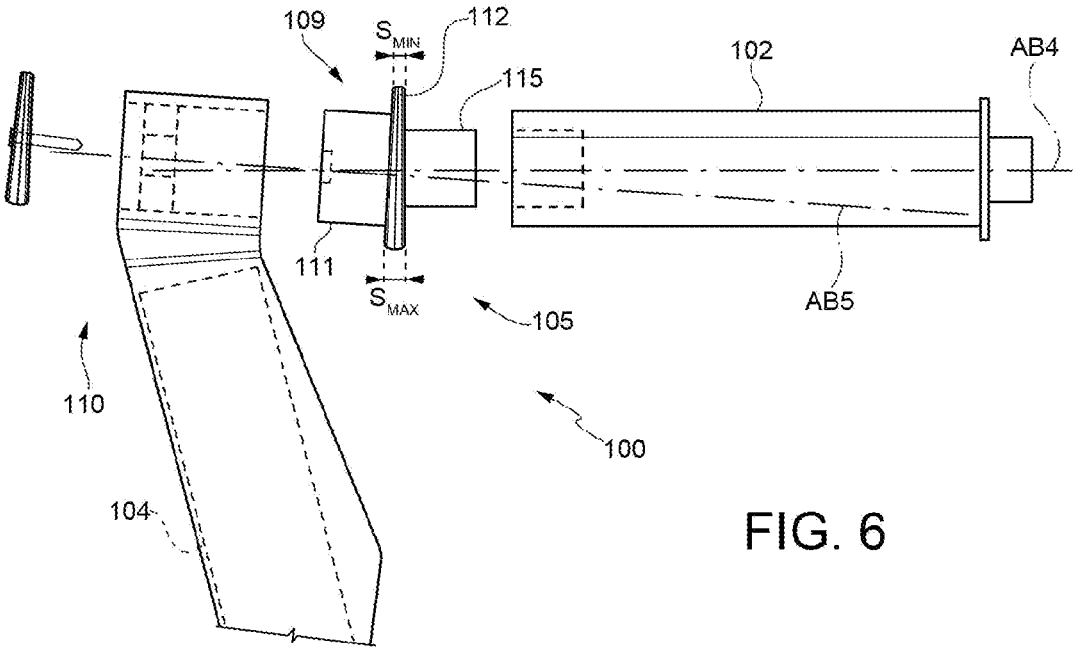
FIG. 6 is an exploded right-hand lateral view of the detail of FIG. 5, in a second operating configuration.

In an alternative embodiment, to which FIGS. 5 and 6 refer, adjusting members 105 between a handgrip 102 and a support pole 104 of a crutch 100 comprise a first articulated joint element 109 and a second articulated joint element 110. The first articulated joint element 109 comprises a cylindrical portion 111 and a flange 112 substantially as already described. Furthermore, a pin 115, having longitudinal axis AB4 offset with respect to a longitudinal axis AB5 of the cylindrical portion 111, protrudes from the side of the flange 112. The pin 115 is press-fitted into a cavity 113 in the handgrip 2.

The second articulated joint element 110 is shaped and coupled to the first articulated joint element 109 substantially as already described.

Figure 8:
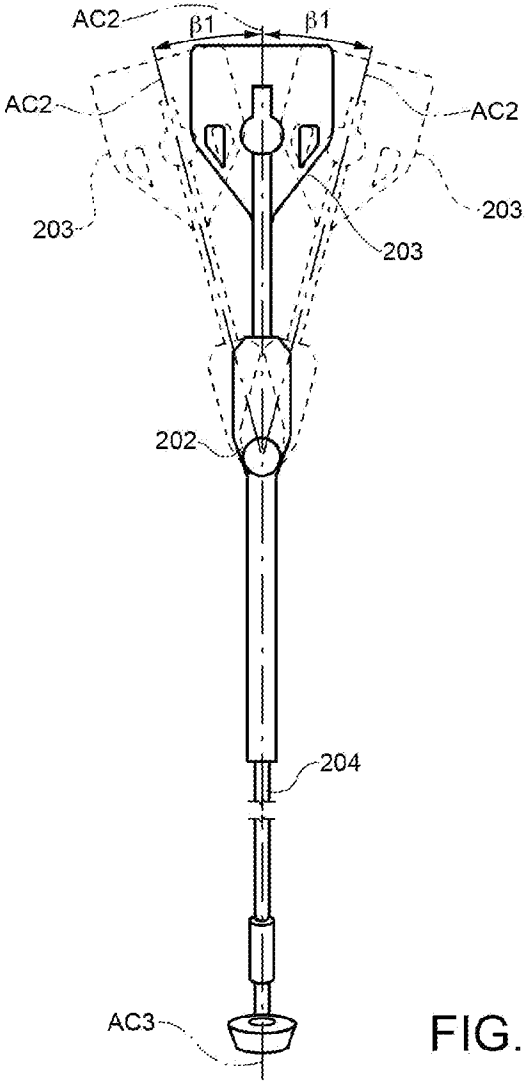
FIG. 8 is a rear view of the crutch of FIG. 7.
Figure 7:
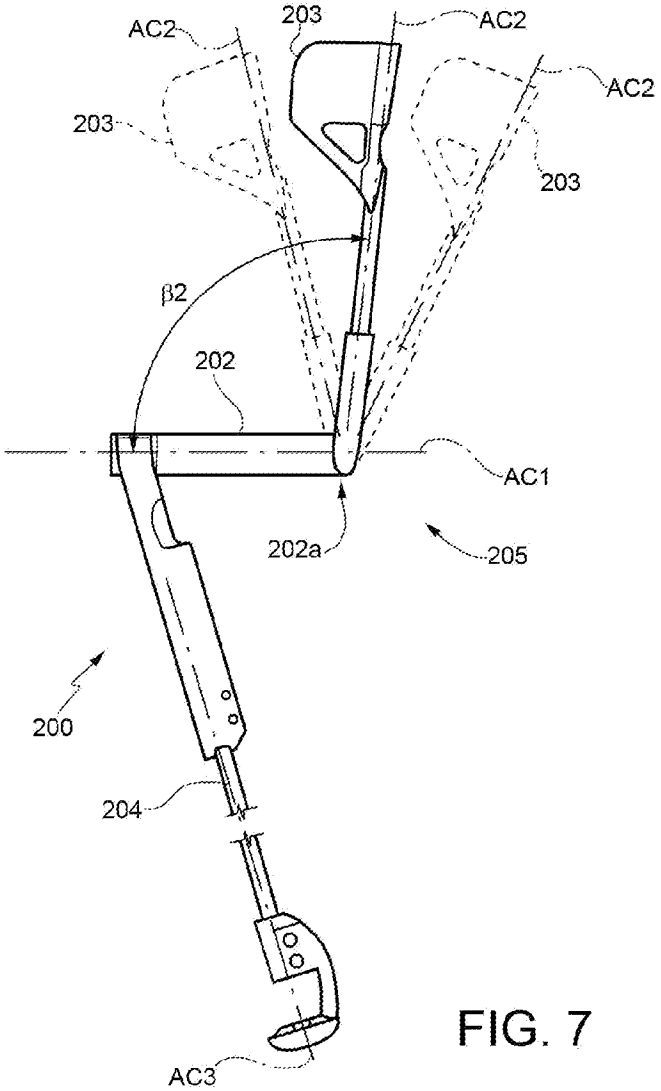
FIG. 7 is a right-hand lateral view of a crutch according to a further embodiment of the present invention.

According to the embodiment illustrated in FIGS. 7 and 8, a crutch 200 comprises a handgrip 202, a forearm support 203 and a support pole 204, which extend respectively along a first axis AC1, a second axis AC2 and a third axis AC3. The crutch 200 furthermore comprises adjusting members 205, for adjusting an angular position of the forearm support 203 with respect to the handgrip 202 and the support pole 204.

The adjusting members 205 are interposed between the handgrip 202 and the forearm support 203 and allow modification of the direction of the second axis AC2 of the forearm support 203 so as to adjust a first angle β1 between the axis AC2 and a plane defined by the first axis AC1 of the handgrip 202 and the third axis AC3 of the support pole 204 (FIG. 8) and a second angle β2 between the second axis AC2 and the first axis AC1 (i.e. between the forearm support 203 and the handgrip 202, FIG. 7).

In particular, the forearm support 203 is hinged to a rear end 202*a* of the handgrip 202 around a pin axis lying on a plane defined by the first axis AD1 and by the second axis AD2.

Figure 10:
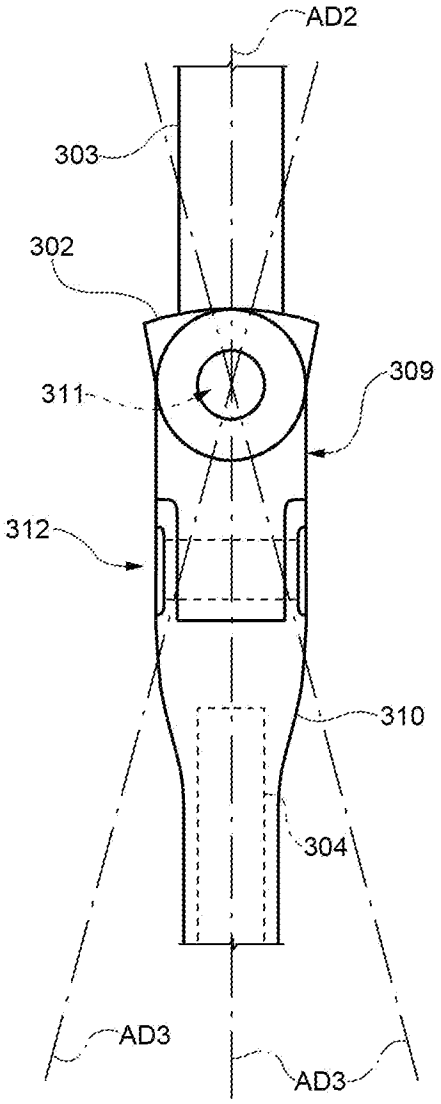
FIG. 10 is a front view of the crutch of FIG. 9.
Figure 9:
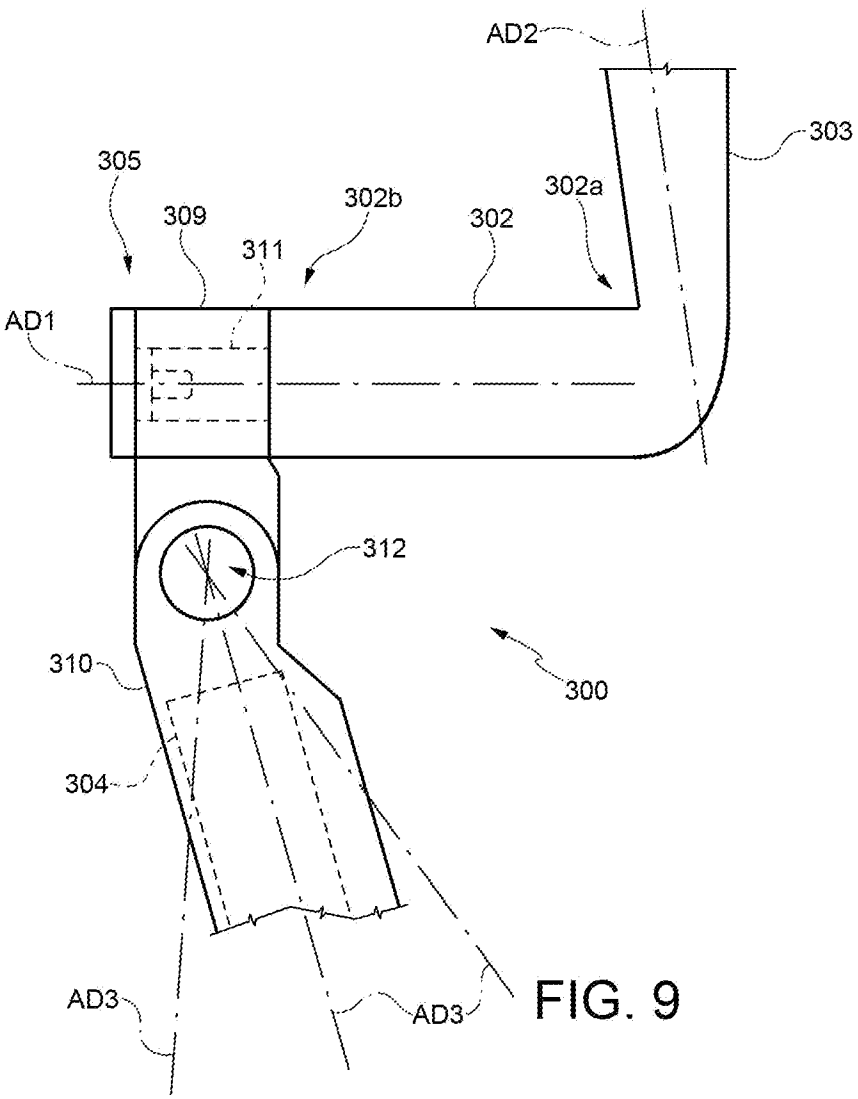
FIG. 9 is a right-hand lateral view of a crutch according to a further embodiment of the present invention.

According to a further embodiment of the invention, illustrated in FIGS. 9 and 10, a crutch 300 comprises a handgrip 302, a forearm support 303 and a support pole 304 which extend respectively along a first axis AD1, a second axis AD2 and a third axis AD3 (the forearm support 303 and the support pole 304, which are connected respectively to a front end 302*a* and to a rear end 302*b* of the handgrip 302, are only partly illustrated). The crutch 300 furthermore comprises adjusting members 305, for adjusting an angular position of the support pole 304 with respect to the handgrip 302 and the forearm support 303.

In detail, the adjusting members 305 comprise a first articulated joint element 309, rotatably coupled to a pin 311 at the front end 302 of the handgrip, a second articulated joint element 310, rigidly connected to the support pole 304, and a hinge joint 312 between the first articulated joint element 309 and the second articulated joint element 310.

The hinge joint 312 has a hinge axis AD4 perpendicular to a plane defined by the first axis AD1 of the handgrip 302 and by the third axis AD3 of the support pole 304.

Figure 12:
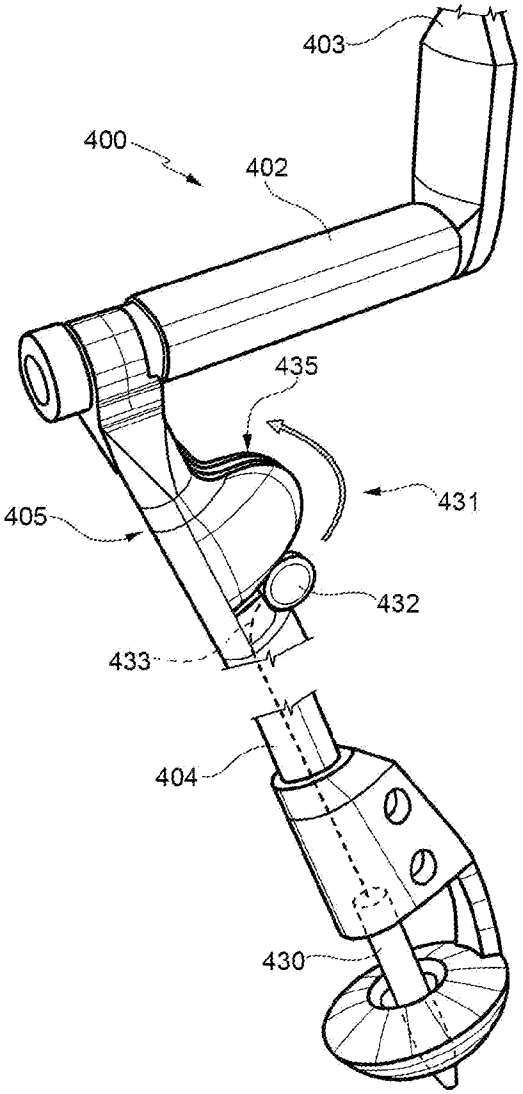
FIG. 12 is a right-hand lateral view of the crutch of FIG. 11 in a second operating configuration.
Figure 11:
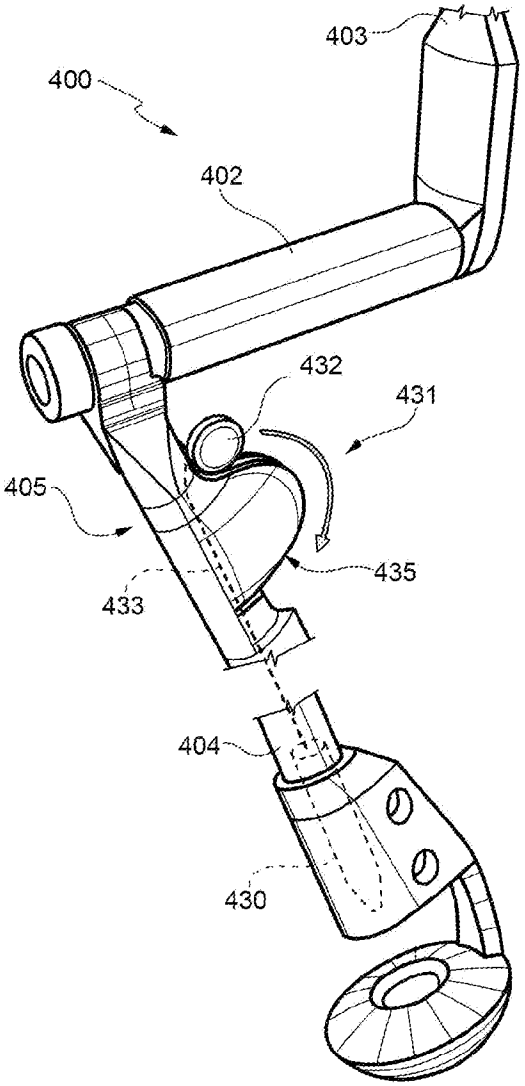
FIG. 11 is a right-hand lateral view of a crutch according to a further embodiment of the present invention, in a first operating configuration.

According to one embodiment, illustrated in FIGS. 11 and 12, a crutch 400 comprises a handgrip 402, a forearm support 403, a support pole 404 and adjusting members 405, substantially as already described with reference to the figures from 1 to 4. The crutch 400 furthermore comprises a tool 430 at the lower end of the support pole 404 and an actuator device 431 for the tool 430. In the example described, the tool 430 is a tip for improving stability on slippery ground, such as snow or ice.

In a first operating configuration (FIG. 11), the tool 430 is retracted inside the support pole 404. In a second operating configuration (FIG. 12), the tool 430 is extracted and protrudes from the lower end of the support pole 430 to allow gripping on the ground.

The actuator device 431 comprises a manoeuvring element 432, for example a ring, a wire 433 connected between the manoeuvring element 432 and the tool 430 inside the support pole 404, and a guide 435 fitted to the support pole 404 near the handgrip 402.

The manoeuvring element 432 moves along the guide 435 between a first stable position, to which the first operating configuration of the tool 430 corresponds, and a second stable position, to which the second operating configuration of the tool 430 corresponds.

Figure 13:
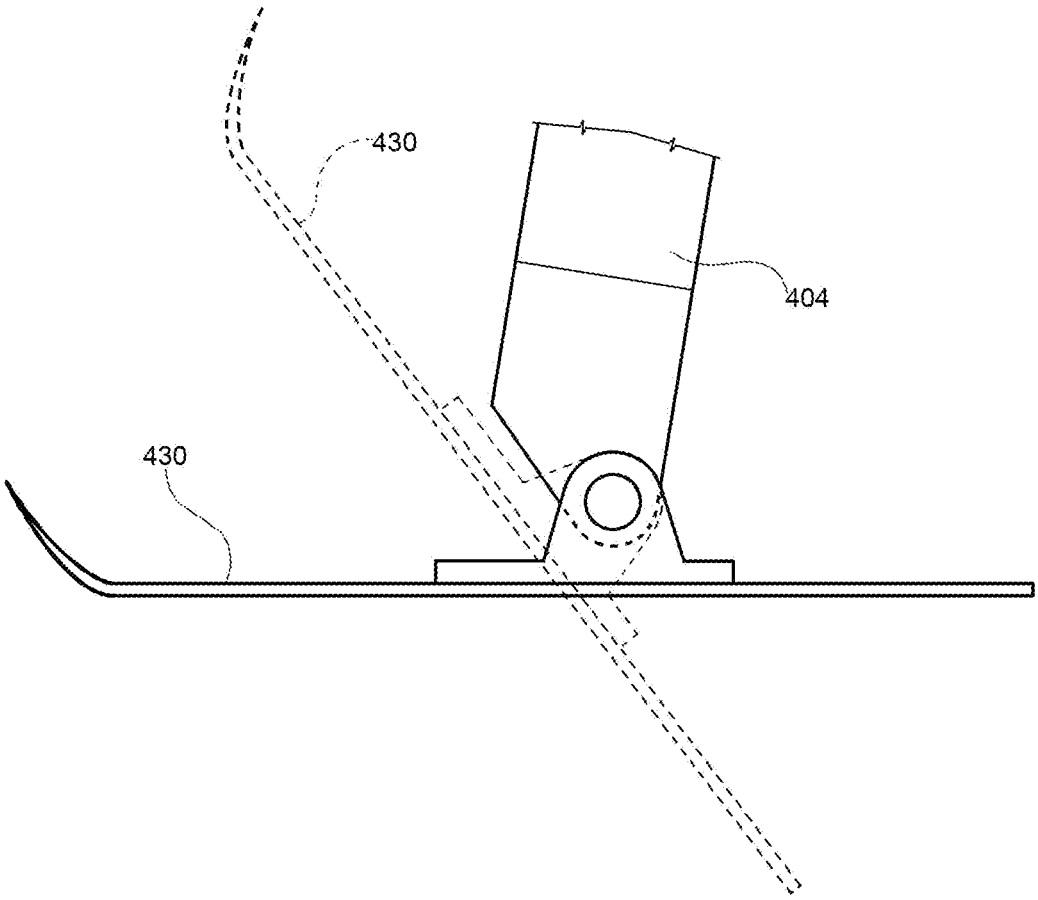
FIG. 13 is a right-hand lateral view of a crutch according to a further embodiment of the present invention.

In a different embodiment (FIG. 13), the tool 430 is replaced by a tool 430' which, in the example, is a stabiliser for skiing. The tool 430' is hinged to the lower end of the support pole 404 and has a first operating configuration, in which it is free to follow the undulations of the slope on which it is used, and a second configuration, in which the tip is maintained in a raised position near the support pole 404 to lower the tail and allow pushing on level ground.

Modifications and variations can be made to the crutch described, without departing from the scope of the present invention, as defined in the attached claims.

Firstly it is possible to use any type of adjusting members that allow the adjustments described.

Furthermore, the same crutch may comprise adjusting members both between the handgrip and the support pole, and between the handgrip and the forearm support, to allow independent adjustments.

The invention claimed is:

1. A crutch comprising:

a handgrip extending along a first axis;

a forearm support, having a stem that extends along a second axis and is connected to a back end of the handgrip, wherein the forearm support is hinged to the back end of the handgrip about a hinge axis that belongs to a plane defined by the first axis and the second axis;

a support pole, extending along a third axis and connected to a front end of the handgrip, wherein the support pole is hinged to the front end of the handgrip about a hinge axis that belongs to a plane defined by the first axis and the second axis; and adjusting members, configured to adjust an angular position of at least one of the support pole and the forearm support with respect to the handgrip.

2. The crutch according to claim 1, wherein the adjusting members, are configured to adjust at least one of a direction of the second axis and a direction of the third axis with respect to a direction of the first axis.

3. The crutch according to claim 1, wherein the adjusting members, are configured to adjust an angle between the third axis of the support pole and a plane defined by the first axis of the handgrip and the second axis of the forearm support.

4. The crutch according to claim 1, wherein the adjusting members, are configured to lock the handgrip, the forearm support and the support pole selectively in one of a plurality of relative positions in which the third axis of the support pole is transverse to a plane defined by the first axis of the handgrip and by the second axis of the forearm support.

5. The crutch according to claim 1, wherein the hinge axis is parallel to the first axis.

6. The crutch according to claim 1, wherein the adjusting members, are configured to adjust an angle between the third axis of the support pole and the first axis of the handgrip.

7. The crutch according to claim 1, wherein the adjusting members, comprise a first articulated joint element, having a cylindrical portion provided with a flange; wherein the flange has a first face, adjacent to the cylindrical portion and perpendicular to an axis of the cylindrical portion, and a second face, tilted with respect to the first face; and wherein the first articulated joint element is adapted to a be coupled to the handgrip with the flange abutting a backing surface of the handgrip selectively in one of a first position, in which a minimum thickness region (SMIN) of the flange is arranged below the axis of the cylindrical portion and a maximum thickness region (SMAX) of the flange is arranged above the axis of the cylindrical portion, and a second position, in which the minimum thickness region (SMIN) of the flange is arranged above the axis of the cylindrical portion and the maximum thickness region (SMAX) of the flange is arranged below the axis of the cylindrical portion.

8. The crutch according to claim 7, wherein the adjusting members, comprise a second articulated joint element, arranged at an upper end of the support pole and having a cylindrical seat rotatably coupled to the cylindrical portion of the first articulated joint element.

9. The crutch according to claim 8, wherein the second articulated joint element has a sliding surface perpendicular to the axis of the cylindrical portion and arranged against the first face of the flange when the first articulated joint element and the second articulated joint element are coupled.

10. The crutch according to claim 1, wherein the adjusting members comprise a first articulated joint element, rotatably coupled to the front end of the handgrip, a second articulated joint element, rigidly connected to the support pole, and a hinge joint between the first articulated joint element and the second articulated joint element.

11. The crutch according to claim 10, wherein the hinge joint has a hinge axis perpendicular to a plane defined by the first axis of the handgrip and by the third axis of the support pole.

12. The crutch according to claim 1, wherein the adjusting members are interposed between the handgrip and the forearm support.

13. The crutch according to claim 1, comprising reversible locking means of the adjusting members.

14. The crutch according to claim 1, comprising a tool at a lower end of the support pole and an actuation mechanism for the tool, adapted to set the tool selectively in one of a first operating configuration and a second operating configuration.

* * * * *